US006736057B1

(12) United States Patent
Larson

(10) Patent No.: US 6,736,057 B1
(45) Date of Patent: May 18, 2004

(54) ECONOMICAL SCREEN-STRETCHING DEVICE

(76) Inventor: James D. Larson, 6323-83rd Ave. SE., Snohomish, WA (US) 98290-9208

( * ) Notice: Subject to any disclaimer, the term of this patent is extended or adjusted under 35 U.S.C. 154(b) by 0 days.

(21) Appl. No.: 10/280,226

(22) Filed: Oct. 25, 2002

(51) Int. Cl.[7] ..... B05C 17/08; B41F 15/36

(52) U.S. Cl. ..... 101/127.1; 38/102.21

(58) Field of Search ..... 101/114, 115, 101/126, 127, 127.1, 128.1, 129; 38/102.1, 102, 102.21, 102.4, 102.91; 160/378, 381, 391, 395, 403

(56) References Cited

U.S. PATENT DOCUMENTS 3,601,912 A * 8/1971 Dubbs ..... 38/102.91
5,127,176 A * 7/1992 Newman ..... 38/102.1
5,163,367 A * 11/1992 Newman ..... 101/127.1
5,488,901 A * 2/1996 Hruska ..... 101/129
5,676,052 A * 10/1997 Wegrzyn et al. ..... 101/127.1
5,937,753 A * 8/1999 McKeever ..... 101/127.1
6,070,526 A * 6/2000 Larson ..... 101/129
6,505,552 B1 * 1/2003 Larson ..... 101/127.1

* cited by examiner

*Primary Examiner*—Leslie J. Evanisko
(74) *Attorney, Agent, or Firm*—Jensen & Puntigam PS

(57) ABSTRACT

A device for supporting the corner of a silkscreen frame during the stretching and attachment of the silkscreen, including a unifying plate to support the various elements. The plate is removably secured to a table and includes a position defining corner support flanked by a pair of spaced torsion absorbing pads and a calibrated tower to capture the stretching tool and assuring proper and constant tension.

5 Claims, 4 Drawing Sheets

FIG. 6
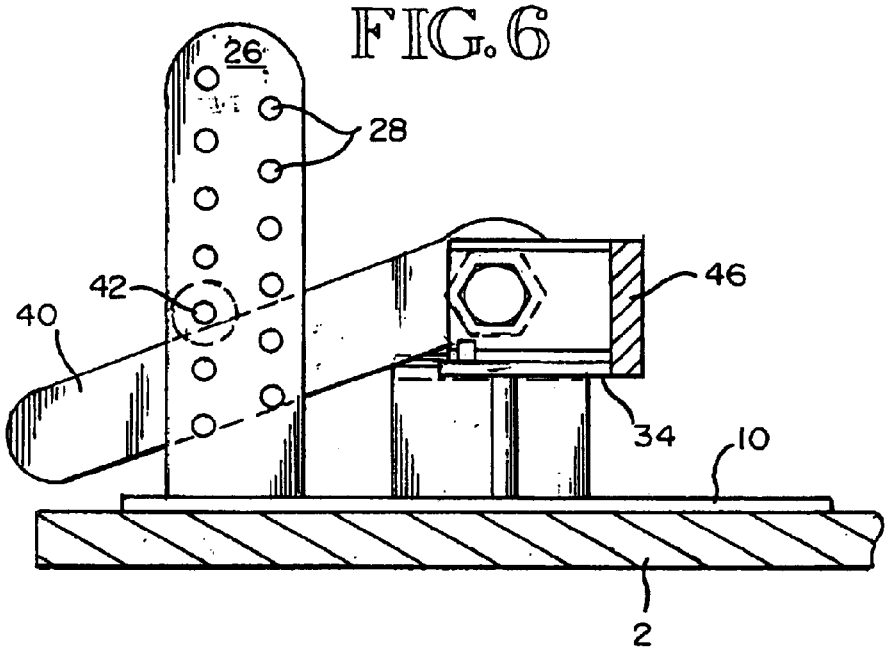
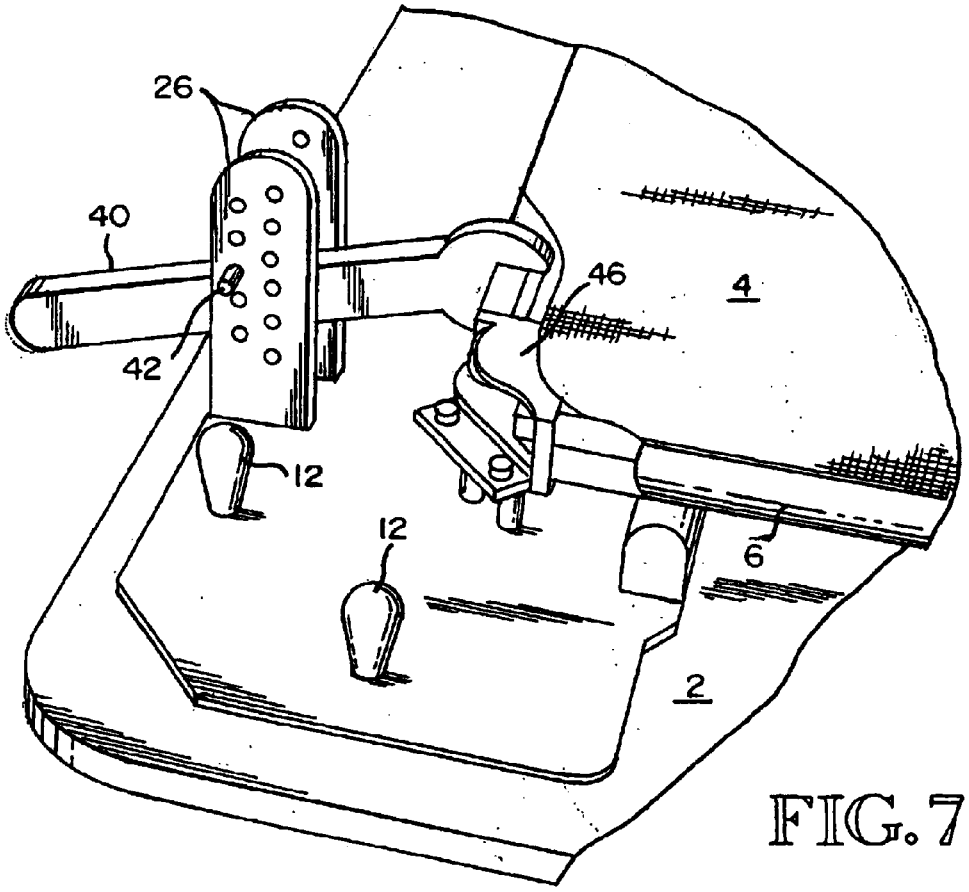
FIG. 7

ECONOMICAL SCREEN-STRETCHING DEVICE

TECHNICAL FIELD

This invention relates to improvements in devices for stretching silkscreen for use in the silkscreening process, and more particularly to a simplified, universal, low-cost stretching device which is quick and easy to use.

BACKGROUND OF THE INVENTION

Historically, the silkscreening process has involved a labor-intensive and highly skilled task of securing the screen on a stretching frame and applying the appropriate tension to the screen to achieve a clear and precise image during the transfer, particularly when using multi-colors.

Over the years, improvements have been made which reduced the skill and time involved, including, tensionable frames wherein the sides of the frames were of elongated cylinders which could be rotated about their axis, applying tension the silkscreen fabric, and then fastened in place to the adjacent cornerpiece once the appropriate tension had been reached.

Further improvements included a tensioning of the frame through the use of hydraulic or pneumatic means that either replaced mechanical means or augmented the mechanical means.

Still another step forward was realized when the silkscreen was pre-cut to size, including an allowance for the bending of the side frame during the tensioning process. This pre-cutting of the fabric and placing splines on the edges allowed the screen to be quickly snapped into pre-provided slots in the stretching frame sides, but also allowed the user to purchase exactly the amount of fabric necessary, and further allowed the tensioning to be achieved through the use of calibration means, which assured that the same tension would be applied to the screens each time used. When using a pre-cut screen, the operator need only read the calibration number provided for that screen and replicate that number on a stretching device which includes calibration.

Prior art references known to the present inventor include:

U.S. Pat. No. 3,601,912, which discloses an early woven screen-stretching frame;

U.S. Pat. No. 4,525,909, granted to Newman, Jul. 2, 1985, discloses an improved method of securing the fabric to the stretching frame;

U.S. Pat. No. 5,113,611, granted to Rosson, May 19, 1992, discloses a method and apparatus for stretching silkscreen wherein the silkscreen frame itself is expanded to stretch the screen;

U.S. Pat. No. 5,443,003, granted to Larson, Aug. 22, 1995, discloses a method and apparatus for pre-cutting a piece of fabric, then attaching said fabric to a spline which is then snapped into the sides of a silkscreen-stretching device;

U.S. Pat. No. 5,488,901, granted to Hruska, Feb. 6, 1996, discloses a silkscreen-stretching device including lever-enhanced pneumatic or hydraulic cylinders for performing the stretching upon a stretching frame secured to the upper portion of the table;

U.S. Pat. No. 5,676,052, Wegrzyn et al., Oct. 14, 1997, discloses an apparatus for securing a frame-mounted screen to a table and then using the human torso as a means of placing tension of the screen;

U.S. Pat. No. 5,913,263, granted to Hruska, Jun. 22, 1999, discloses yet another method of using hydraulics or pneumatics for tightening the screen; and U.S. Pat. No. 5,937,753, granted to McKeever, discloses yet another apparatus for applying the appropriate tension to the screen which is secured to a frame.

DISCLOSURE OF THE INVENTION

With the above noted prior art in mind, it is a feature of the present invention to provide a silkscreen tension device which is inexpensive and easy to operate.

Another feature of the present invention is the provision of a silkscreen-stretching device which requires minimal skill of the operator and yields consistent results.

Still another feature of the present invention lies in the fact that the current device is readily adapted to different fabrics.

A further feature of the present invention is found in the additional support provided to the frame during the stretching process to reduce the torque on the frame elements and thus reducing the possibility of fatigue.

BRIEF DESCRIPTION OF THE DRAWINGS

FIG. 6 is a sectional view through the corner of one element of the stretching device.

FIG. 7 is a perspective view of one corner of the device with the hold-down and stretching wrench in place.

BEST MODE FOR CARRYING OUT THE INVENTION

Figure 1:
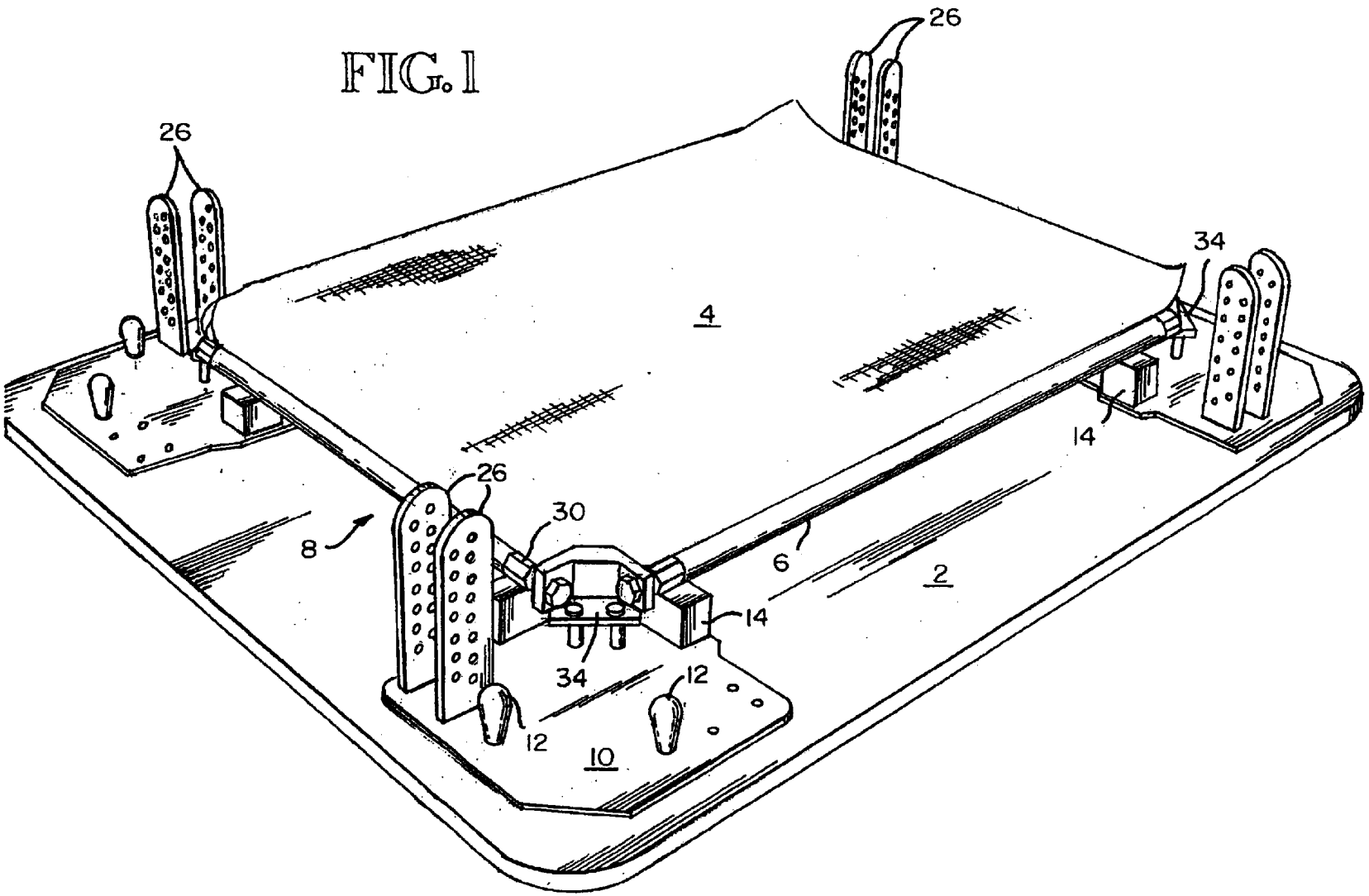
FIG. 1 is an isometric view of a silkscreen-stretching frame attached to a turntable supporting the stretching apparatus.

As seen in FIG. 1, there is a supporting table 2 which could be a turntable such that the operator could stand in one position and rotate the table such that he could sequentially operate on the corners stretching the silkscreen 4 which is mounted to a plurality of rotatable sides 6 of the rectangular frame 8, upon which the screen is stretched. It is understood that the silkscreening is not done at this station, but simply the silkscreen is placed to the proper tension and the rotatable sides 6 moved to the appropriate position, and then the frame, including the secured silkscreen, is moved to the printing station or placed in storage. It is further to be understood that re-tensioning the screen can also be done at this station.

A plurality of plates 10 are removably secured to table 2 and may be easily removed or repositioned using securement devices 12 which can be placed a variety of holes in the table 2 to adjust for different sizes of rectangular frames. Attached to each of the plates 10 and standing upwardly therefrom are a pair of torsion absorbing, low friction pads 14 upon which the sides 6 of frame 8 rest and which absorb the torque generated during the tensioning of the screen, thereby preventing metal fatigue.

Likewise on the plate 10, there are a pair of upwardly extending plates 26, having a plurality of calibrated holes 28, such that, as explained hereinafter, when the operator is placing the silkscreen 4 under tension, he or she places a wrench around the flats located at opposite ends of each side 6, and turns the side to the designated holes 28 in towers 26, and as explained hereinafter, places a pin in the holes 28 to prevent a screen from slacking while he tightens the securement bolts 32 (see FIGS. 2 and 3), preventing further rotation of the sides 6.

Figure 2:
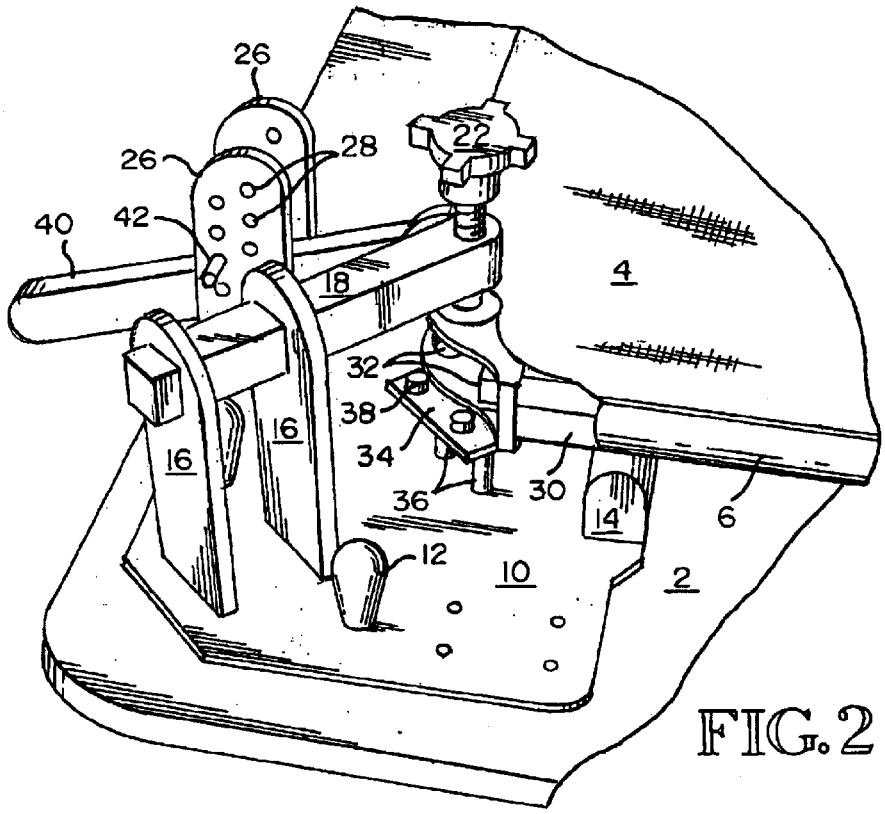
FIG. 2 is an enlarged view of one of the corners of FIG. 1, with the screen being held down with a hold-down device and the tension maintained with a standard wrench being framed in a calibrated restraining tower.

Reference is now had to FIG. 2, where in addition to the parts described hereinabove with respect to FIG. 1, hold-down towers 16 mounted to plate 10 through which is passed a horizontal, retractable arm 18, having at the end thereof a threaded hold-down element 20, having a handle 22 and a frame contacting foot 24, such that when the arm is extended, the hold-down elements 20 and 22 extend over the corner of the frame. The operator can rotate handle 22 and threaded member 20, which places foot 24 in contact with the frame and holds it securely in place. There can also be seen the outermost portion of the screen supporting platform having an upper plate 34, including upwardly resting protrusions 38 to locate the corner of the screen supported by legs 36, which extend to the plate 10, mounted to table 2. Also seen in this view is the handle of the wrench 40, which is held in position against the torque by a pin 42, as explained hereinafter. The working end of the wrench 40 engages the flats 30 of the sides 6, and the operator moves the wrench handle 40 to a position indicated on the screen and reflected by the calibrated towers 26 and is locked into position.

Figure 3:
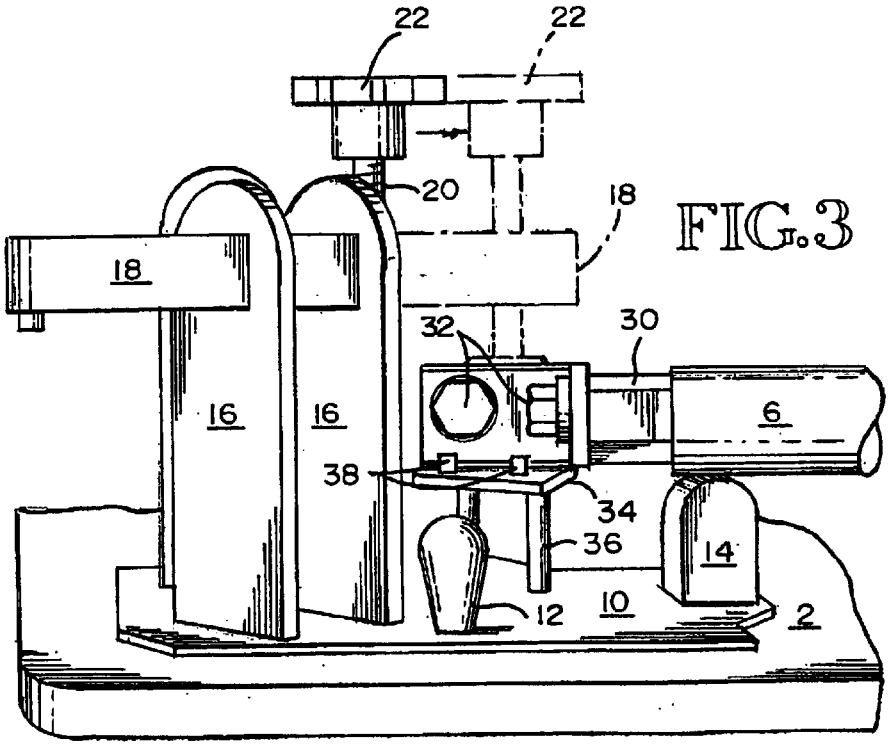
FIG. 3 is an elevational view showing the inventive apparatus with the hold-down device being shown in a hold-down position.

As seen in FIG. 3, the hold-down mechanisms 18, 20, 22 and 24 can be slid forwardly and rearwardly in tower 16 allowing it to overlie the corner of the frame where it is screwed down to hold the frame in position, or moved out of the way to provide easier access for placing or removing a screen.

Figure 4:
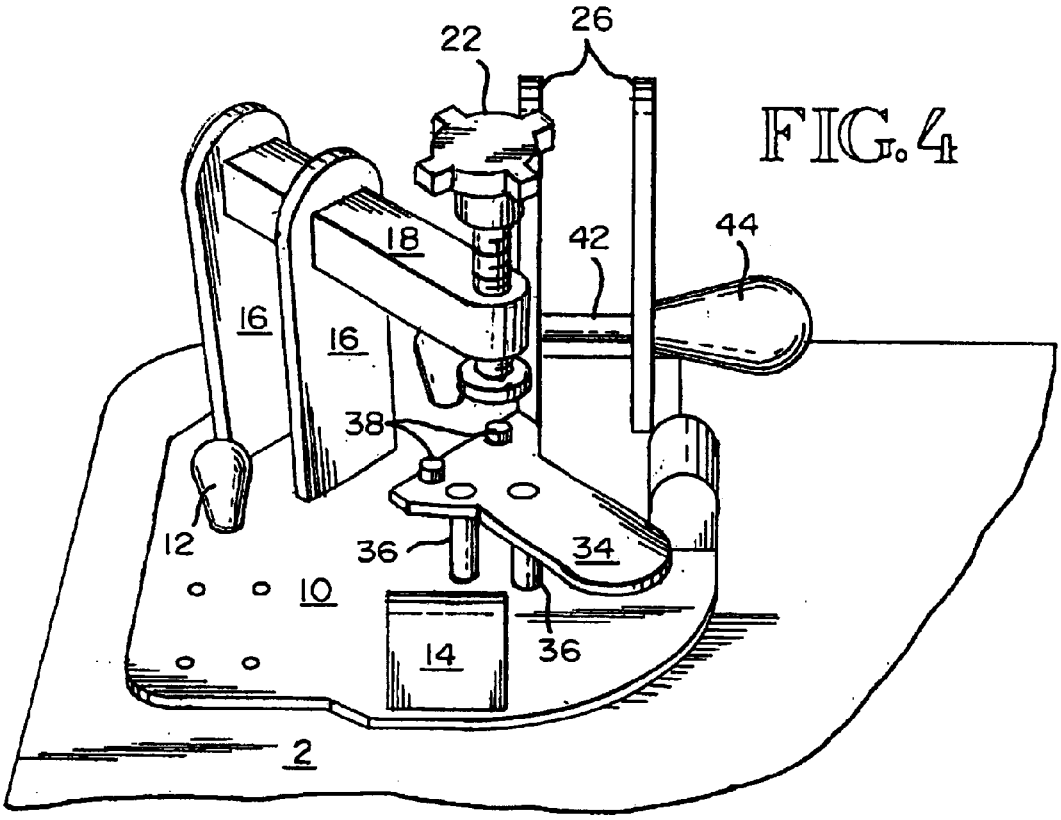
FIG. 4 is a view similar to FIG. 2 with the silkscreen and frame removed such that the inventive structure may be more clearly seen.

FIG. 4, shown without any screen in position, illustrates the configuration of the support plate 34, supported by three legs 36, as well as the interrelationship between the calibrated towers 26 and the removable pin 42, which has a handle 44.

Figure 5:
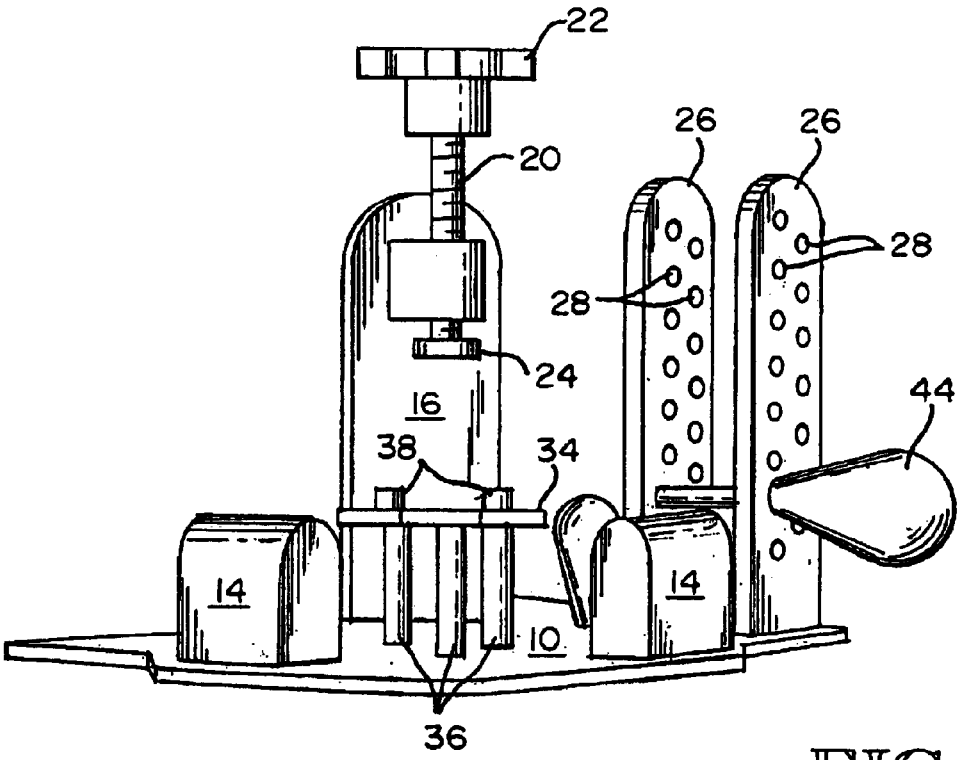
FIG. 5 is an elevational section of the inventive apparatus as seen in FIG. 1.

FIG. 5 is an elevational view of the device of FIGS. 2 through 4, without the table 2, and gives another perspective of the interrelationship of the elements, reinforcing the fact that the commercial version need not include the table.

FIG. 6 is a sectional view adjacent to calibrated towers 26, and shows the interrelationship of the wrench handle 40 and the removable pin 42, and showing in cross-section the corner piece 46, which interconnects with corner member 46 of the frame, which is supported by plate 34.

FIG. 7 is another view of the corner of the frame supporting elements, showing the relationship and giving a more complete view of the corner piece 46, wherein the interrelationship of the plate element 34 supporting the corner 46 of the frame having side 6 with respect to the calibrated towers 26 permits the wrench handle 40 to be at a position vertically below the sides, thereby eliminating the need for the hold-down structure, and greatly simplifying the entire operation and reducing cost.

Thus, as can be seen, the present inventive device when appropriately secured to a table allows for a quick, reliable and inexpensive way to assure the silkscreen is set to the appropriate tension.

What is claimed is:

1. A device for supporting a rectangular silk screen frame having rotatable sides while tensioning the silkscreen, comprising:

a working surface including supports for the corners of the frame, wherein the supports are adjustable along the surface to accommodate frames of differing sizes;

a plurality of support pads adjacent the corner supports to support the sides and absorb the torque generated while tensioning the silkscreen; and calibrated means adjacent the corner supports for interaction with a tensioning tool whereby the silkscreen may be quickly and easily brought to a predetermined tension.

2. A device as in claim 1, where the calibrated means is a rigid tower to which the tool may be secured.

3. A device as in claim 1, and further including means to temporarily hold the frame in place prior to tensioning.

4. A device as in claim 1, wherein the support pads are of a low friction material.

5. A device for securing a corner of a silkscreen frame during the attachment and stretching of a screen, comprising:

a flat support plate for releasable securement to a table;

securement means attached to the flat support plate for securing the plate to the table;

a platform for the support and alignment of the corner of the silkscreen frame;

a pair of low friction elements adjacent the platform on opposite sides thereof, along perpendicular lines that intersect at the platform; and a calibrated tower spaced from the platform to capture a tool used to tension the screen.

* * * * *